US008115639B2

(12) United States Patent
Forster

(10) Patent No.: US 8,115,639 B2
(45) Date of Patent: Feb. 14, 2012

(54) LAUNDRY TAG

(75) Inventor: Deborah Anne Forster, York (GB)

(73) Assignee: Stay Put Systems Limited, London (GB)

( * ) Notice: Subject to any disclaimer, the term of this patent is extended or adjusted under 35 U.S.C. 154(b) by 516 days.

(21) Appl. No.: 11/989,500

(22) PCT Filed: Jul. 17, 2006

(86) PCT No.: PCT/GB2006/002650

§ 371 (c)(1),
(2), (4) Date: Apr. 10, 2009

(87) PCT Pub. No.: WO2007/012810

PCT Pub. Date: Feb. 1, 2007

(65) Prior Publication Data

US 2009/0212912 A1 Aug. 27, 2009

(30) Foreign Application Priority Data

Jul. 29, 2005 (GB) ..... 0515593.2
Sep. 23, 2005 (GB) ..... 0519442.8

(51) Int. Cl.
*G08B 13/14* (2006.01)
*E05B 65/00* (2006.01)

(52) U.S. Cl. ..... 340/572.8; 340/572.9; 70/57.1

(58) Field of Classification Search ..... 340/572.1, 340/572.2, 572.8, 572.9, 568.1, 568.4, 568.5, 340/568.6, 571; 70/57.1; 235/492; D10/104, D10/106, 108, 106.9, 106.91, 106.92, 104.1
See application file for complete search history.

(56) References Cited

U.S. PATENT DOCUMENTS

| | | | | |
|---|---|---|---|---|
| 4,785,563 | A | 11/1988 | Friedman | |
| 5,655,392 | A * | 8/1997 | Holmgren | 70/57.1 |
| 5,785,181 | A | 7/1998 | Quartararo, Jr. | |
| 5,841,349 | A * | 11/1998 | Holmgren | 340/572.2 |
| 5,969,614 | A * | 10/1999 | Holmgren | 340/572.9 |
| 6,239,737 | B1 * | 5/2001 | Black | 342/51 |
| 6,779,731 | B2 * | 8/2004 | Duldhardt | 235/492 |
| 7,183,917 | B2 * | 2/2007 | Piccoli et al. | 340/572.1 |
| 7,256,699 | B2 * | 8/2007 | Tethrake et al. | 340/572.8 |

FOREIGN PATENT DOCUMENTS

| | | | |
|---|---|---|---|
| DE | 29721385 | U1 | 1/1999 |
| DE | 20104647 | U1 | 9/2001 |
| EP | 0057915 | | 8/1982 |
| EP | 0440306 | A1 | 8/1991 |
| EP | 0589533 | A1 | 3/1994 |
| EP | 0738798 | A1 | 10/1996 |
| EP | 0911756 | A2 | 4/1999 |
| EP | 1582804 | A9 | 5/2005 |
| WO | WO 87/06109 | | 10/1987 |
| WO | WO 01/95250 | A1 | 12/2001 |
| WO | WO 03/010712 | A1 | 6/2003 |

* cited by examiner

*Primary Examiner* — Jennifer Mehmood
(74) *Attorney, Agent, or Firm* — Jacobson Holman PLLC

(57) ABSTRACT

A laundry tag is described comprising a first male portion (1) having at least one projecting member (3), and a second female portion (2) defining a recessed region (4) to receive the projecting member and fixedly engage thereupon to hold the two portions together, wherein one of the said portions comprises a passive RFID transponder (7). A laundry tagging kit and laundry management system and a method of tagging laundry to operate such a system are also described.

14 Claims, 1 Drawing Sheet

LAUNDRY TAG

Figure 1A:
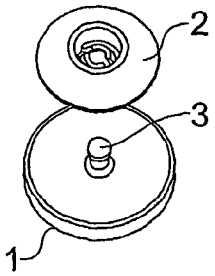
Figure 1C:
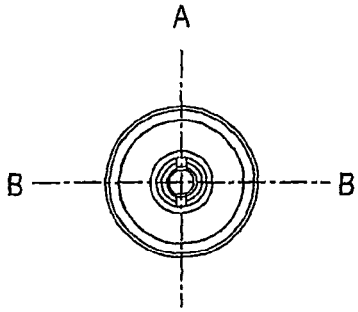
Figure 1D:
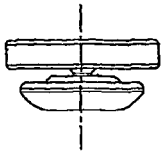
Figure 1B:
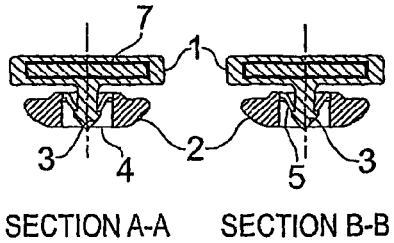
Figure 1B:
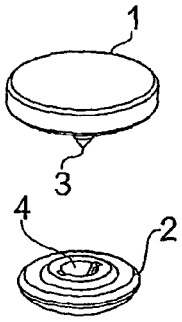
Figure 1E:
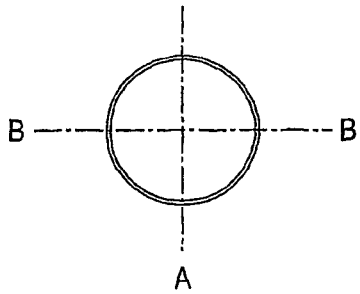

This is a national stage of PCT/GB06/002650 filed Jul. 17, 2006 and published in English.

The invention relates to a laundry tag, a kit for tagging laundry including tag readers, a method of tagging laundry, and a system for tracking and maintaining an inventory of laundry items within a laundry situation. In particular, the invention relates to a tagging method or tracking system in which laundry belonging to multiple owners is permanently tagged for item control, tracking and identification purposes.

Items of laundry, whether clothing, bed linen or other items, may be tagged to facilitate processing by a laundry in various situations. A laundry or laundry department which serves a business that has occasion to wash large volumes of laundry items of its own ownership, for example a hotel, restaurant, residential care home, other residential establishment, establishment supplying hire clothing such as uniforms or the like, might wish to tag laundry items for a range of information or identification purposes, for example to facilitate smooth handling of items. Most particularly, a laundry which handles items from a variety of owners, such as a hotel, residential care home or the like, or commercial laundry, will have a particular requirement to tag laundry so as to be able to identify ownership and track the item to ensure that it is returned to the correct owner.

The invention in particular relates to situations where a laundry expects to handle multiple items repeatedly for its multiple owners, as might for example be the case in a residential care home or the like, and where it is therefore desirable to have an effective way of tagging items that can be expected to be repeatedly processed so as to ensure ownership is correctly tracked and identified, and consequently of tagging items with a tag that is permanent and stable over repeated laundry cycle.

Traditionally, fabric labels might be attached by a laundry to an item of clothing, perhaps carrying a simple reference code. These generally offer only a one-off solution for a single laundry cycle and can carry only a very limited amount of information.

More sophisticated laundry tag labels have included readable barcodes. These might be referenced to a suitable database on which is stored information concerning, for example, ownership details, processing instructions, laundering, drying and ironing conditions and the like. The greater information which can be stored on a barcode can be used in conjunction with such a database to improve accuracy of tracking, ensure items are not lost, and automate some stages of the laundry process.

For high value items and/or for establishments with large scale operation it has been suggested that a passive radio frequency identification (RFID) transponder might be used as an identification device as a more sophisticated alternative to a barcode. Such a device might carry more information, and can be read from a limited distance.

In the prior art, this is typically either suggested for batch identification only, or else where it is used for item identification is described as incorporated into the item of clothing or other laundry, for example by being sewn into an edge seam. Such a system can be particularly effective at identifying and referencing a database of laundry items for an individual owner with a large scale laundry operation, such as a hotel handling its bed and table linen, a catering establishment, a clothes hire establishment, uniform provider or the like. It is particularly directed at enabling the laundry process to be automated, by allowing items to be identified and associated processing instructions retrieved and followed.

It is also known to sew in at the point of manufacture an RFID device as an authentication label for high value clothes, for example those carrying a high value trade mark or the like.

Solutions involving the sewing in of a tag, or otherwise involving the permanent attachment of a tag by its fabrication into the garment or other laundry item are not so practical in application to the multiple-owner laundry situation, where it is desirable to have tags which can be attached rapidly to individual laundry items by the laundry operator as and when the owners require use of the laundry service.

RFID transponder devices are also known as security devices which are temporarily and removably attachable to clothes to prevent theft. In these circumstances, the RFID transponders are typically large and bulky to maximise the signal, do not need to carry an individual identifier since their purpose is merely to alert to unauthorised removal of the item through a simple large scale reader, and are deliberately obtrusive and designed to be removable. They are therefore of limited relevance to the present problem.

It is an object of the invention to provide a laundry tag, method and system which mitigates some or all of the above disadvantages of existing laundry tagging methods and systems.

It is a particular preferred object of the invention to provide a laundry tagging system in which a readable tag which is inherently readily attachable to clothing or other laundry items, to allow for the individual identification of a laundry item in particular to refer to a database of owners and ensure that ownership of the item can be tracked for control and identification purposes.

It is a particular preferred object of the invention to provide a laundry tag for use in such a system and method which can be attached in a permanent but unobtrusive manner to be effective through multiple laundry cycles.

Thus, in accordance with the invention in a first aspect, a laundry tag comprises a first male portion having at least one projecting member, a second female portion defining a recessed region to receive the projecting member and fixedly engage thereupon to hold the two portions together, wherein one of the said portions comprises a passive RFID transponder.

In use the male and female portions are joined together on either side of a part of the material of the laundry item, for example on the textile of the item itself or on an attached label such as is typically provided to give manufacturer details, laundry instructions or the like, or on some other suitable point on the garment or other laundry item. The projecting member passes through the laundry item and is received in the recess in the second female portion. It is received therein to form a permanent or semi-permanent attachment, with the two portions of the laundry tag forming an integrally joined whole which sandwiches the fabric or other part of the laundry item on which it is engaged.

In particular, either or both of the male and female portions, or at least the projecting and recessed regions thereof, are flexibly resilient to facilitate mating of the two portions. Often it will be preferable for the male portion or projecting member to be more rigid than its counterpart.

Thus, a tag in accordance with the invention is readily and rapidly attached to the laundry item of a user of the laundry service. This is much more practical for the laundry service than a sewn in tag, whether incorporated at the time of manufacture of the laundry item or otherwise, would be. The tag is simply attachable to the item by the laundry as and when the need arises.

Each of the first and second, or male and female portions of the tag is preferably a generally flat, planar formation, save for the projecting member in the former case which conveniently projects generally perpendicularly out of the plane of the said flat planar formation of the male portion. In a preferred embodiment, one or both planar formations of the respective portions of the laundry tag may be disc like.

In a preferred embodiment at least the portion comprising the RFID transponder is disc like, with the RFID comprising a coil disposed toward the circumference of the disc, around a centrally located projecting member or recessed region as the case may be.

In a preferred embodiment, the male portion comprises a generally flat disc having a projecting member extending generally perpendicularly from a centre thereof, and the female portion comprises a generally flat annulus with a centrally located aperture suitably sized and shaped to receive the said projecting member.

It is desirable for the tags to be as unobtrusive as possible, since the intention is that they will be permanently attached to the item of clothing. To facilitate this, they are preferably attached in as unobtrusive a site as possible. They are also preferably small, for example each portion has a maximum dimension, for example across each generally planar formation (and in the case of a disc has a diameter) of less than 15 mm and most preferably less than 10 mm.

At this small size, any incorporated RFID transponder can carry only a limited amount of information. Accordingly, it is intended in use that each transponder will carry merely a unique numerical identifier, which will be read with reference to a stored database from which more detailed ownership and other information can be retrieved in the manner described in greater detail below. Nevertheless, it is preferable that each transponder has at least a 32-bit, and more preferably a 64-bit identifier capacity.

In accordance with the invention, the tag is fixedly retained in a manner intended to be permanent or semi-permanent, which in this context is to say that it is not intended to be removable at least during the normal course of washing. The projecting member and recessed region thus together constitute an engagement mechanism to fixedly retain the assembled tag on the laundry in use in permanent or semi-permanent attachment.

In one alternative, referred to herein as semi-permanent attachment, the engagement mechanism is intended to be robust enough to remain affixedly attached during multiple normal laundry cycles, and all other normal wear and tear, but to be removable and reusable should the need arise. Thus, the engagement mechanism is not readily reversible to disengage, but may be disengaged by application of a specific process, and for example using a special disengagement tool. Such a semi-permanent attachment allows the tag to be attached to a laundry item for a sustained period, for example for the life of the laundry item and/or for the length of the identification requirement, but nevertheless allows the tags to be recycled for reuse on other items on the same basis.

Suitable semi-permanent engaging mechanisms might include mechanisms that can be released to reverse the engagement without damaging the assembly, in particular though not limited to under the application of a specific tool. For example, resiliently deformable formations in the recessed region, for example inherently resiliently deformable or comprising formations of spring loaded members, may be provided which lockingly engage on a part of the male portion, such as a projecting detent, but which can be depressed to allow its subsequent release. Key operating lock mechanisms may be provided. Reversible threaded connections may be provided.

However, in a preferred embodiment, the engagement of the tag is intended to be permanent, which in this context is to say that it is not intended to be removable at all. In this manner, a laundry item is permanently and irreversibly labelled, and at the end of its useful life the tag is discarded with the laundry item.

This is for example achieved in that the attachment mechanism between the male and female portions of the tag comprises a locking mechanism which cannot so easily be released without damaging the assembly.

For example the projecting member is adapted to be received in a corresponding recess or aperture in the female portion and has a profiled element, for example at or towards a distal end thereof, and for example comprising a suitably shaped formation at or towards the distal end such as a circumferential detent or other formation profiled to taper towards the distal end, allowing it to be inserted relatively readily into a recessed region and in particular a corresponding aperture in the female portion but (with detent or other formation and aperture suitably co-operably sized) resisting its withdrawal.

Additionally or alternatively the projecting member is adapted to be received in a corresponding recess or aperture in the female portion and frangible/permanently deformable elements may be provided within a recess or aperture and/or a projecting member so acting as to inhibit separation once the two portions are attached.

Additional or alternatively a fusible element may be provided to be fused under the action of a suitable attachment tool to create a permanent connection and/or glue may be applied.

Additional or alternatively, the projecting member may be discontinuously threaded, with a threaded length portion and an unthreaded length portion of longitudinal extent greater than a longitudinal thread pitch of the threaded length portion. The projecting member is threaded such that there is provided a head formation, an unthreaded threaded length portion proximal to the head formation, and a threaded length portion distal to the head formation and for example in the region of and extending to the distal end of the projecting member.

In this way, in use once the threaded length of the projecting member is driven through a complementary recess, (and for example a complementarily threaded recess) in the other portion of the tag to its full extent by a screw action, the unthreaded length of the projecting member then sits loosely within the said aperture, and the threading process is not reversible by a screw action.

In an embodiment, the male portion of the tag compromises a head including a transponder as hereinbefore described, for example formed as a disc, and a projecting member having a threaded distal end (that is, a threaded length portion in the region of the distal end), and an unthreaded shank (that is, an unthreaded length portion) between the threaded distal end portion and the head, the unthreaded shank being in longitudinal extent at least one entire thread pitch, but preferably less than the length of the threaded distal end length portion. Such a screwing arrangement can self tap through the cloth of the laundry item, into a suitable female portion, and drive fully through the recess in the female portion until such point as the shank sits loosely and freely rotates within the recess, and reverse threading to detach is no longer possible.

The threaded distal end length portion is conveniently suitable shaped, for example, being tapered towards the distal end of the projecting member and/or provided with an engagement formation presenting a generally planar reward engagement face, to facilitate engagement and/or inhibit disengagement as described.

Thus the attachment of the two portions to the item of laundry is intended to be permanent rather than removable, and the two portions are capable of remaining connected in normal laundry conditions through multiple laundry cycles to give the individual item of laundry a unique and readily readable identification number which can be referred to the database as described below.

Given the intended permanent nature of the tag, there is a need for the tag to withstand repeated wash and iron cycles. The flat profile and permanent fixing helps, but the passive RFID transponder device must be protected from an environment which is particularly harsh, both chemically and in terms of temperature. Accordingly, the passive RFID transponder must be provided with a protective covering to withstand temperatures of at least 125° C., and more preferably temperatures of at least 200° C., and to withstand the harsh chemical environments typically encountered in the laundry situation. Most conveniently, this is achieved in that the passive RFID transponder comprised an RFID coil encapsulated entirely within the first or second portion of the tag as the case may be.

This imposes a material requirement on the material of at least that portion of, and preferably the entire, tag. It must have good thermal and chemical stability. In the preferred embodiment it should not interfere excessively with the reading of the encapsulated RFID coil. Nevertheless it is also desirable that the tag is readily fabricated via a mass production technique. Preferably, the casing material of the tag comprises polymeric material with the necessary temperature and chemical stability, and is for example nylon or PPS (polyphenylene sulfide).

The encapsulated RFID transponder is a coiled antenna of suitable conductor in electrical connection with a suitable memory chip as will be familiar.

The precise frequency of operation is not considered critical to the invention. The standard ISO 18000 for air interface communication frequencies is relevant, and the tag is preferably adapted to operate at, and the system described below adapted to operate at one of these standard protocols. A preferred frequency for operation is 13.56 MHz.

In accordance with a further aspect the invention preferably comprises a laundry tagging kit comprising a plurality of laundry tags as hereinbefore described each carrying a unique identifier and further provided with at least one tag data reader. The tag data reader includes in familiar manner a suitable radio frequency transmitter and receiver to read the unique identifier given to each tag.

The tagging lit may optionally further include a tag attachment device that assists in mating of the male and female portions, and may also effect locking thereof especially if a permanently deformable or frangible or fusible element on one or other portion effects this, or if the portions are to be adhesively bonded together.

In accordance with a further aspect of the invention a laundry management system comprises a tagging kit as above described, preferably including a plurality of tag data readers, and further comprising a data register to store information associated with each unique tag identification number, which information comprises at least the owner of each laundry item, and optionally further details concerning the item, its description, laundry or care instructions, ongoing delivery instructions or the like.

Preferably, the system further comprises a data communications link to facilitate data communication between a tag data reader and the data register, and a display means to display information to a user.

In accordance with a further aspect of the invention, a method of tagging an item of laundry to enable its tracking comprises fabricating a tag having a first male portion with a projecting member, and a second female portion defining a recessed region to receive the projecting member; Incorporating into, and in particular encapsulating fully within, one of the said portions a passive RFID transponder; engaging the male and female portion together upon an item of laundry, for example on either side of a fabric portion thereof, or on either side of an attached label or other convenient point, such as to effect a fixed and preferably permanent or semi-permanent attachment of the tag to the laundry item.

In a further aspect of the invention a method of operation of a laundry tagging system to identify at least the owner of individual items of laundry within the system comprises the steps of:

Attaching a tag to each item of laundry in accordance with the method of the previous aspect;

providing at least one radio frequency tag reader capable of reading the unique identifier on each tag;

providing a data register in data communication link with the said tag reader to store information relating to each unique identifier including at least the owner of the laundry item;

as and when necessary, reading the tag with the reader, retrieving the unique identifier, passing the unique identifier to the data register via the data communication link, and thereby retrieving at least some of the stored information, and in particular the information identifying the owner of the laundry item.

In accordance with the invention, a simple, user-attachable laundry tag is provided which can be read at a distance and associated with a database of information, including in particular ownership information and so lends itself exceptionally well to the handling of laundry items for multiple owners, for example in a residential situation such as residential care home.

Figure 2A:
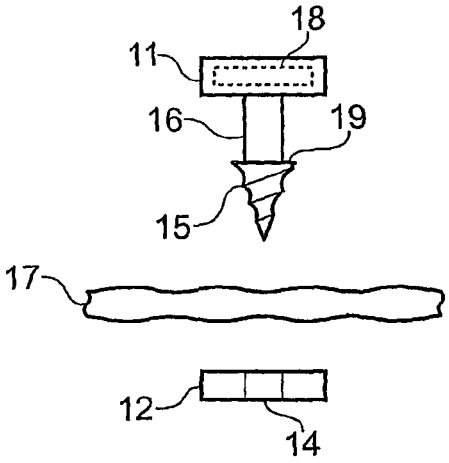
Figure 2B:
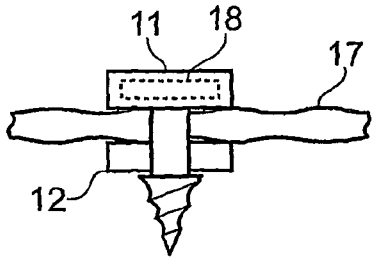

The invention will now be described by way of example only with reference to the figures in which:

FIG. 1 which illustrates a suitable button tag in accordance with the invention;

FIG. 2 illustrates an alternative button tag.

The button is shown in FIGS. 1 (*a*) and (*b*) in perspective view, in FIGS. (*c*) and (*e*) in bottom and top plan views respectively, and in FIG. 1 (*d*) in side view, and is then shown in two cross sections.

In the Figure, the tag comprises two portions, a male portion (1) and a female portion (2).

The first portion (1) comprises a disc of rigid plastic material which is approximately 2 mm thick and approximately 12 mm in diameter. The disc entirely encapsulates and protects an RFID coil (7) (shown in the cross-sectional insets). The disc is provided with a perpendicular projecting member (3).

The second portion (2) comprises a smaller disc of resilient plastic material which is provided with a recess (4) into which the projection (3) can be inserted to effect attachment of the tag.

FIGS. 1 (*a*) to (*b*) show the tag in an unattached configuration. FIGS. 1 (*c*) to (*e*) and the section show the tag in an attached configuration. In use, the two portions (1, 2) are placed either side of a piece of the fabric of the laundry item or other suitable attachment site (not shown) and brought together. The projecting member (3) is profiled to give a conical detent at its end which first facilitates the passage of the projection through the material during the attachment process and then facilitates its retention in that the rear faces of this detent engage flexibly resilient arms (5) in the recessed region and resist and inhibit the withdrawal of the tag. There may be more than one projecting member and complementary recessed region.

Accordingly, the tag is simply but permanently (in the sense that it is not intended to be removable, and is stably fixed to withstand successive laundry cycles) attached to the laundry item. Rapid and ready identification of the item in future during the laundry process is facilitated.

FIG. 2 represents an alternative fixing arrangement for a tag transponder, which is otherwise essentially equivalent to that of FIG. 1. However, in this case, a threading system is provided, which is so configured that it is not readily reversible once fully inserted.

In the figure the tag compromises two portions, a male portion (11) and female portion (12).

The male portion (11) again compromises a disc of rigid plastic material which entirely encapsulates RFID coil (18). The female portion (12) compromises a smaller disc of plastic material which is provided with a recess (14) intended to receive the perpendicular projection from the male portion (11).

In this design, the perpendicular projecting member consists of a threaded end portion (15) making up the part of its length distal to the disc and an unthreaded shank portion (16) making up the part of its length proximal to the disc. The shank portion is of less longitudinal extent than the threaded portion, but is several thread pitches long.

In use the threaded portion of the projecting member threads its way through the fabric (17) and the recess (14) in the female element (12) when rotated. As it is rotated, the threaded portion self-taps its way through the fabric and through the recess in the female element (14). Once the thread portion is completely through the fabric and the female element, the plain unthreaded shank portion sits within the hole created by the recess in the female element and in the cloth, creating the sandwich arrangement of FIG. 2(*b*). The unthreaded shank portion (16) freely rotates within this hole, and the screw mechanism is thus not readily reversed once it is fully engaged. Additionally, the shape of the threaded portion (15), and in particular the reward face (19), are such as to tend to make extraction of the threaded portion irreversible under action of the thread or under rotation of the assembly.

Thus, the threaded embodiment of FIG. 2 again enables the tag to be simply but permanently and stably fixed to the laundry item.

The invention claimed is:

1. A laundry tag comprising a first male portion having a projecting member insertable through a fabric and a second female portion defining a recess to receive the projecting member to fixedly and irreversibly hold the two portions together, wherein one of the said portions includes a passive RFID transponder, wherein the projecting member includes a threaded portion for screw-threaded engagement within the recess of the female portion to irreversibly fix the male portion to the female portion.

2. A laundry tag in accordance with claim 1 wherein the projecting member and recess together comprise a locking mechanism which cannot be released without damaging the assembly.

3. A laundry tag in accordance with claim 1 wherein said recess in the female portion is an aperture.

4. A laundry tag in accordance with claim 1 wherein the projecting member is discontinuously threaded, with a threaded length portion, and an unthreaded length portion of longitudinal extent greater than a longitudinal thread pitch of the threaded length portion.

5. A laundry tag in accordance with claim 4 wherein said threaded portion of said projecting member is at a distal end of said projecting member and said projecting member further includes an unthreaded shank length portion between the threaded distal end and a head of said male portion, the unthreaded shank being in longitudinal extent at least one entire thread pitch, but less than the length of the threaded distal end.

6. A laundry tag in accordance with claim 5 wherein the threaded length portion is tapered towards the distal end of the projecting member.

7. A laundry tag in accordance with claim 1 wherein the passive RFID transponder comprises an RFID coil encapsulated entirely within a portion of the tag.

8. A laundry tagging kit comprising a plurality of laundry tags in accordance with claim 1 each carrying a unique identifier provided together with at least one tag reader which reader includes a suitable radio frequency transmitter and receiver to read the unique identifier given to each tag.

9. A laundry management system comprising a tagging kit in accordance with claim 8 and a data register to store information associated with each unique tag identification number, which information comprises at least the owner of each laundry item.

10. A laundry management system in accordance with claim 9 further comprising a data communications link to facilitate data communication between a tag data reader and the data register, and a display means to display information to a user.

11. A method of tagging an item of laundry to enable its tracking comprising the steps of:

fabricating a tag having a first male portion with a projecting member having a threaded end portion, and a second female portion defining a recessed region to receive the projecting member;

incorporating a passive RFID transponder within one of the said portions;

engaging the male and female portion together upon an item of laundry such as to effect a fixed and irreversible attachment of the tag to the laundry item by screwing the threaded end portion of said projecting member through the item of laundry and into the recessed region of the female portion.

12. A method of operation of a laundry tagging system to identify at least the owner of individual items of laundry within the system comprising attaching a tag to each item of laundry in accordance with the method of claim 11 and the further steps of:

providing at least one radio frequency tag reader capable of reading the unique identifier on each tag;

providing a data register in data communication link with the said tag reader to store information relating to each unique identifier including at least the owner of the laundry item;

as and when necessary, reading the tag with the reader, retrieving the unique identifier, passing the unique identifier to the data register via the data communication link, and thereby retrieving at least some of the stored information, and in particular the information identifying the owner of the laundry item.

13. A laundry tag as claimed in claim 5 wherein said recess comprises an aperture and said unthreaded shank sits loosely within and is freely rotatable within said aperture when said male portion is fixed to said female portion.

14. A laundry tag as claimed in claim 5 wherein the junction between said threaded portion and unthreaded shank portion includes a face portion to prevent extraction of said male portion from said female portion.

* * * * *